US005451179A

United States Patent [19]

LaRoi, Jr. et al.

[11] Patent Number: 5,451,179

[45] Date of Patent: * Sep. 19, 1995

[54] INFLATABLE FLEXIBLE POUCH WITH INNER INFLATABLE STRUCTURE

[75] Inventors: John L. LaRoi, Jr., Lindenhurst; Louis L. Laske, Libertyville, both of Ill.

[73] Assignee: Vonco Products, Inc., Lake Villa, Ill.

[ * ] Notice: The portion of the term of this patent subsequent to Aug. 9, 2011 has been disclaimed.

[21] Appl. No.: 210,341

[22] Filed: Mar. 18, 1994

Related U.S. Application Data

[63] Continuation-in-part of Ser. No. 918,253, Jul. 22, 1992, Pat. No. 5,336,123, which is a continuation-in-part of Ser. No. 865,130, Apr. 8, 1992, abandoned.

[51] Int. Cl.[6] ..... A63H 27/10

[52] U.S. Cl. ..... 446/224; 446/220

[58] Field of Search ..... 446/220, 224, 221; 383/43, 44, 46, 49, 51, 53, 57, 58

[56] References Cited

U.S. PATENT DOCUMENTS

| | | | |
|---|---|---|---|
| 3,106,159 | 10/1963 | Abramson | 383/44 X |
| 3,282,412 | 11/1966 | Corella et al. | 383/44 X |
| 3,313,472 | 4/1967 | Tjerneld et al. | 383/44 X |
| 3,806,025 | 4/1974 | Marshall | 383/44 X |
| 4,581,763 | 4/1986 | Olsen | 383/44 X |
| 4,674,532 | 6/1987 | Koyanagi | 446/224 X |
| 4,723,944 | 2/1988 | Jensen | 383/44 X |
| 4,983,138 | 1/1991 | McGrath | 446/224 |
| 5,102,365 | 4/1992 | Wang | 446/221 |
| 5,108,339 | 4/1992 | Kieves | 446/221 |
| 5,188,558 | 2/1993 | Barton et al. | 446/224 |
| 5,306,194 | 4/1994 | Epstein | 446/224 |

OTHER PUBLICATIONS

Exhibit A, which is a copy of Sheet 3 of 6 of the drawings of Koyanagi, U.S. Patent 4,674,532.

*Primary Examiner*—Mickey Yu

*Attorney, Agent, or Firm*—Speckman, Pauley & Fejer

[57] ABSTRACT

An inflatable flexible pouch having two inner webs positioned between two outer webs. The two inner webs are attached to each other so as to form a channel between both inner webs. Each outer web and each inner web forms a body portion and a neck portion or throat opening. A first outer web is sealably attached to a first inner web and a second outer web is sealably attached to a second inner web, both sealed attachments are positioned at least partially across the neck portion or throat opening of the aligned webs. At least one inner inflatable chamber is formed between both inner webs and positioned within the outer inflatable chamber for providing increased rigidity of the inflated pouch structure. When the flexible pouch is in an inflated condition, communication is preferably closed between each inner inflatable chamber and each outer inflatable chamber, and the inner inflatable chamber is at least partially inflated, for providing even more rigidity. Increased rigidity is particularly beneficial when using a straw or fill tube inserted within the channel for the purpose of holding or otherwise displaying the inflatable flexible pouch.

16 Claims, 12 Drawing Sheets

INFLATABLE FLEXIBLE POUCH WITH INNER INFLATABLE STRUCTURE

This is a continuation-in-part patent application of U.S. patent application having Ser. No. 07/918,253, filed Jul. 22, 1992, now U.S. Pat. No. 5,336,123, which is a continuation-in-part patent application of U.S. patent application having Ser. No. 07/865,130, filed Apr. 8, 1992, now abandoned.

BACKGROUND OF THE INVENTION

1. Field of the Invention

This invention relates to an inflatable flexible pouch that has a valve element formed by a channel between two inner webs of flexible material, which enables the pouch to be inflated by mouth or with a tube, such as a straw, wherein the two inner webs form an inner inflatable chamber that remains in an at least partially inflated condition when the inflatable flexible pouch is maintained in an inflated condition.

2. Description of Prior Art

Conventional flat check valves including two or more layers of film are known. Such conventional check valves are attached, usually heat sealed, at a peripheral edge of a plastic balloon. However, such conventional valves are manufactured at a location separate from the balloon manufacturing and require additional labor and machinery to install the prefabricated conventional valves in the plastic balloon.

U.S. Pat. No. 4,983,138 discloses an inflatable container with a self-sealing valve. The container has two heat sealed film layers joined at the perimeter of the two layers. An exterior slit is formed in one of the layers. A valve film layer is positioned between the two surface layers. The valve layer is heat sealed to the bottom surface film layer from a transition point across to a stem area, leaving a gap between the seal and the transition point. Such heat seal runs in close proximity to the body edge so as to form a narrow channel, the upper boundary of which is formed by the valve layer and the lower boundary of which is formed by the bottom surface layer. Perpendicular creases which form along the container surfaces, when the container is inflated, cross the fluid channel to help seal the container.

Even in view of the known conventional flat valves and the flexible container taught by U.S. Pat. No. 4,983,138, it is apparent that there is still a need for a relatively inexpensive flat check valve that effectively seals an inflated plastic balloon, particularly over an extended time period.

Furthermore, inflatable balloons having conventional flat check valves provide very little structural support in the neck area of the overall balloon structure. Thus, when a conventional balloon is displayed on a straw or a fill tube, the straw or fill tube must have some sort of cone or cup at its end to saddle the balloon into position. The balloon must have an extended tail that is wrapped around and/or through the cup to hold the balloon in position. This method is cumbersome and does not lend itself to retail or promotional use where deflated balloons are sold or given away and then easily inflated and attached to the straw or fill tube by the purchaser or recipient. In view of the structural problems associated with such conventional balloons and conventional flat check valves, it is apparent that there is a need for a balloon or inflatable flexible pouch that can be supported by a fill tube in such a fashion that the body of the balloon remains in an upright position, even when the balloon begins to deflate.

SUMMARY OF THE INVENTION

It is one object of this invention to provide an inflatable flexible pouch which has increased inner structure for preventing the body of the inflatable flexible pouch from bending at a neck portion of the body, particularly when the inflated pouch structure begins to deflate.

It is another object of this invention to provide an inflatable flexible pouch that has an outer inflatable chamber and an inner inflatable chamber positioned within the outer inflatable chamber, particularly such that the inner inflatable chamber remains in an at least partially inflated condition when the outer inflatable chamber is inflated.

It is another object of this invention to provide an inflatable flexible pouch wherein communication between an outer inflatable chamber and an inner inflatable chamber is prevented when the flexible pouch is in an inflated condition.

It is yet another object of this invention to provide an inflatable flexible pouch that is manufactured by an automated machine process, so as to reduce material and labor costs associated with manufacturing.

It is still another object to this invention to provide an inflatable flexible pouch that uses internal pressure, when in an inflated condition, to seal the flat check valve and to firmly retain a tube or straw where positioned within a channel of a neck portion of the flexible pouch.

According to this invention, the combination of an inner inflatable chamber within an outer inflatable chamber increases the rigidity of the inner structure of the pouch, when inflated, which thus helps to maintain a supporting rod or fill tube in a fixed position with respect to the overall structure of an inflated flexible pouch. Maintaining the fill tube in a fixed position relative to the overall structure of the inflated flexible pouch is important since the fill tube is often used to support the inflated flexible pouch when displayed, for example with an advertisement or message printed on an exterior surface of the pouch.

The above and other objects of this invention are accomplished with an inflatable flexible pouch that has two inner webs and two outer webs. According to one preferred embodiment of this invention, the two inner webs are attached to each other so as to form a channel between both inner webs. One of the two inner webs can be sized so that it is only large enough to form the channel. In one preferred embodiment of this invention, the channel itself can act as the inner inflatable chamber. Both inner webs are preferably positioned between the two outer webs. The four webs are preferably layered together so that a neck portion or throat opening of each web is aligned. The body portion of each web can have any desired peripheral shape.

Each outer web is preferably heat sealed to a respective inner web across the neck portion or throat opening. The two outer webs are heat sealed about a general periphery of both outer webs and along both side sections of the neck portion or throat opening. The two inner webs are also preferably heat sealed from an upper edge or a free edge of each inner web to and along both side sections of the neck portion or throat opening. Such heat seal of the inner webs extends along such neck portion or throat opening at least as far as the heat seals between the inner and outer webs. In one preferred embodiment according to this invention, an approximately semi-annular space is formed between each inner web and its respective outer web, along at least a portion of the length of the neck portion or throat opening.

A portion of the peripheral heat seal of the flexible pouch, within the neck portion, forms a throat opening between both inner webs. In a deflated condition of the inflatable flexible pouch, the channel is in communication with an inflatable chamber between both outer webs. In an inflated condition of the inflatable flexible pouch, both inner webs are forced against each other in a channel area and thus form a seal which prevents communication between the channel and both the inner inflatable chamber and the outer inflatable chamber. The throat opening is also in communication with the channel and an ambient atmosphere surrounding the inflatable flexible pouch.

According to another preferred embodiment of this invention, the two inner webs form at least one inner inflatable chamber between the two inner webs which when inflated is positioned between both outer webs, within the outer inflatable chamber. In such preferred embodiment, the channel through which the fluid flows for inflating the flexible pouch is preferably designed so that the inner inflatable chamber inflates either before or simultaneously with the outer inflatable chamber. However, it is apparent that given a suitable design of the inner webs and the corresponding channels formed between such inner webs, according to one preferred embodiment of this invention, the outer inflatable chamber may inflate before the inner inflatable chamber. Each inner inflatable chamber adds rigidity to the inner webs, particularly when maintained in an at least partially inflated condition, and thus the inner pouch structure, when the pouch is in an inflated condition.

It is apparent that the body of the inflatable flexible pouch can have any suitable and desired overall shape. It is also apparent that the body portion can merge into the neck portion or throat opening and form any suitable shape. Thus, the overall perimeter of the inflatable flexible pouch can form many different shapes. It is further apparent that the inflatable flexible pouch can have one or more neck portions or throat openings and thus one or more channels for inflating the inflatable flexible pouch.

BRIEF DESCRIPTION OF THE DRAWINGS

This invention and the various embodiments will be described in further detail in conjunction with the drawings wherein.

DESCRIPTION OF PREFERRED EMBODIMENTS

Figure 1:
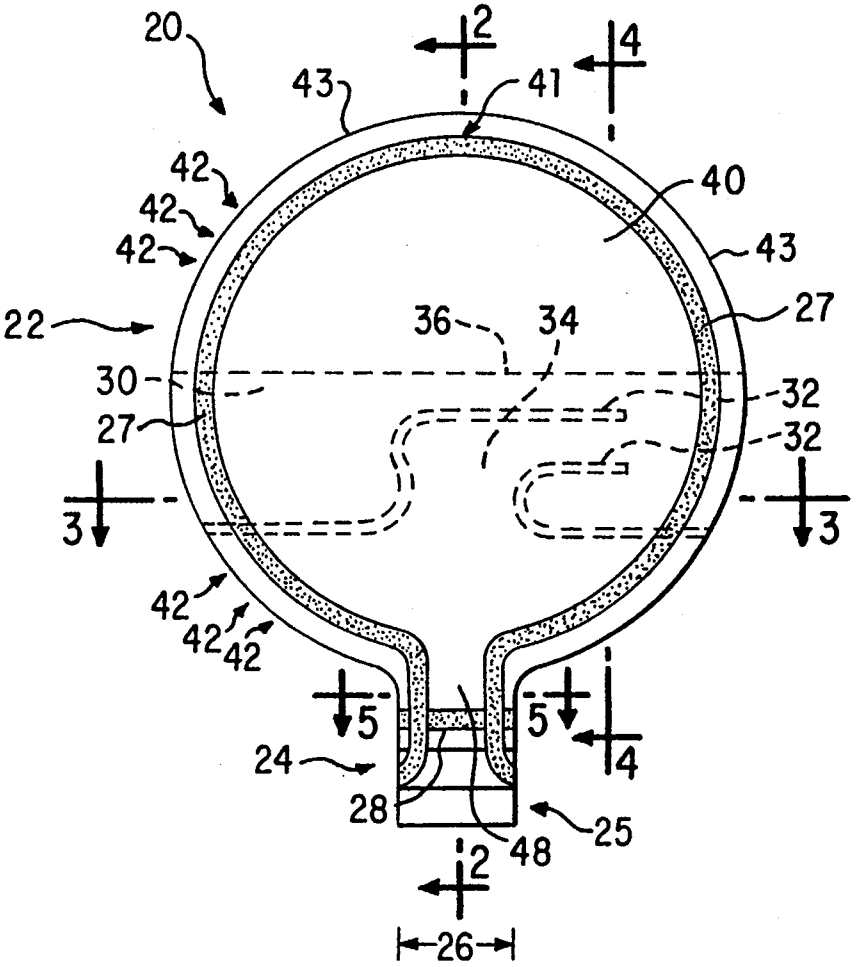
FIG. 1 is a front view of an inflatable flexible pouch having an overall round shape, according to one preferred embodiment of this invention.

Referring to FIG. 1, inflatable flexible pouch 20 is shown in a front view. According to the preferred embodiment as shown in FIG. 1, inflatable flexible pouch 20 comprises two inner webs 30 and two outer webs 40. It is apparent that each outer web 40 can have any suitable shape in order to achieve a desired overall form of inflatable flexible pouch 20, such as an oval balloon, a heart-shaped balloon, a box-shaped balloon, or the like.

Attachment means are used to attach both inner webs 30 to each other, so as to form channel 34 between both inner webs 30. In FIGS. 1, 10, 22, 23, and 26–34, heat seals used to secure inner webs 30 with respect to each other are shown by dashed lines whereas heat seals used to secure outer webs 40 with respect to each other are shown by dotted band areas between two solid lines. As shown in FIG. 1, heat seal 32 is used to attach both inner webs 30 to each other and thereby form channel 34. Although heat seal 32 is preferably shown as a continuous seal, heat seal 32 can also comprise a non-continuous, skip or broken heat seal or other bonding of both inner webs 30. However, continuous heat seals 32 ensures that all entering air, or other fluid, will flow through channel 34. Likewise, with continuous heat seals 32, all backflowing air must pass through channel 34 and because of the particular path such escaping air must follow, a better seal is formed. It is apparent that heat seal 32 can form any suitable shape of channel 34, such as those shapes shown in FIGS. 11–13.

Figure 6:
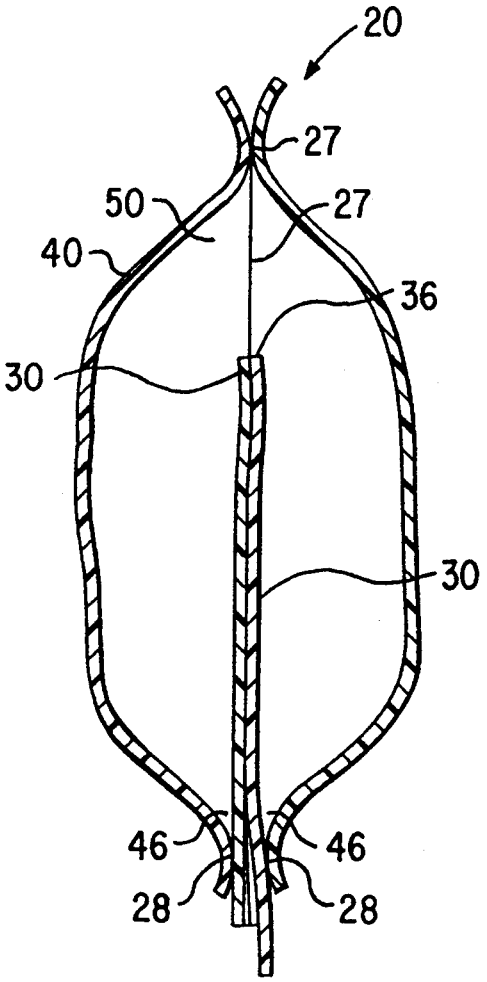
FIG. 6 is a sectional view taken along line 2—2, of the inflatable flexible pouch, according to the embodiment as shown in FIG. 1, in an inflated condition.
Figure 7:
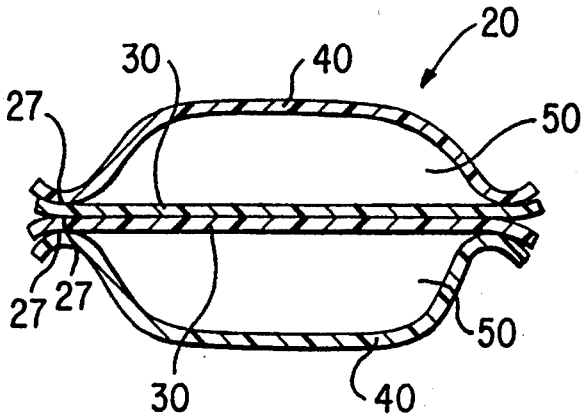
FIG. 7 is a sectional view taken along line 3—3, of the inflated flexible pouch, according to the embodiment as shown in FIG. 1.
Figure 8:
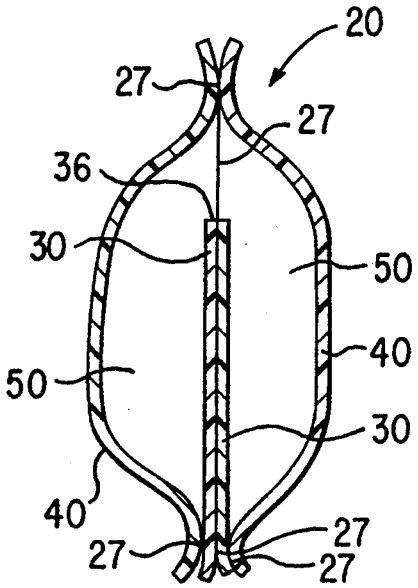
FIG. 8 is a sectional view taken along line 4—4, of the inflated flexible pouch, according to the embodiment as shown in FIG. 1.

The uppermost heat seal 32 as shown in FIGS. 1, 10, 11 and 12 can be used to stop a straw or fill tube 49 from passing through inner webs 30 beyond free edge 36 or into inflatable chamber 50. The shape of heat seals 32 as shown in the preferred embodiment of FIGS. 20 and 21 can also be used for such purpose. Channel 34 preferably has a tortuous path, which enhances those sealing capabilities between inner webs 30 used to close communication between channel 34 and inflatable chamber 50, as shown in FIGS. 6 and 8, when inflatable flexible pouch 20 is in an inflated condition.

Figure 20:
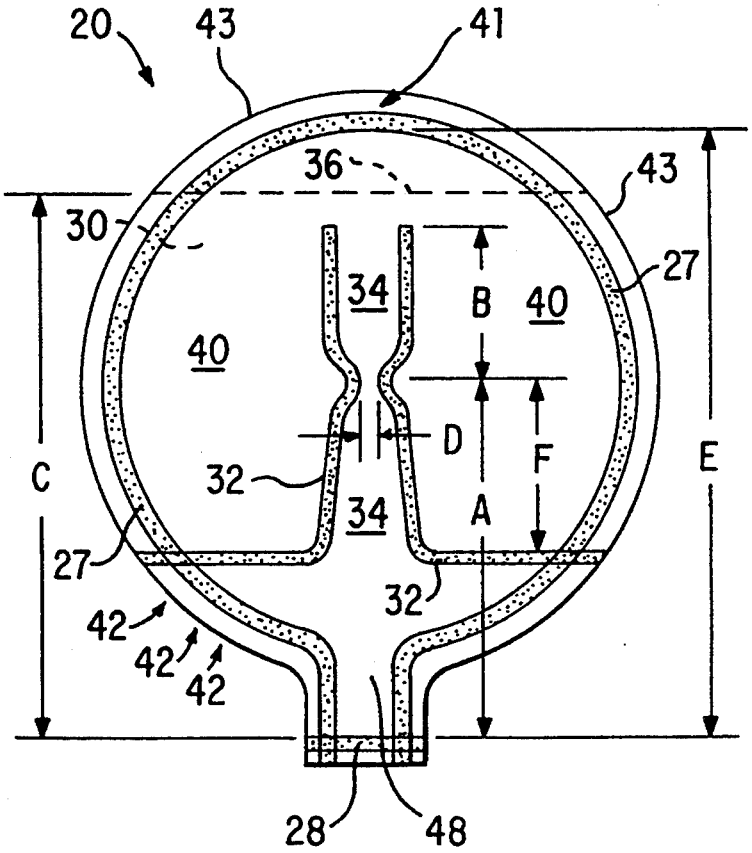
FIG. 20 is a front view of an inflatable flexible pouch according to another preferred embodiment of this invention.
Figure 21:
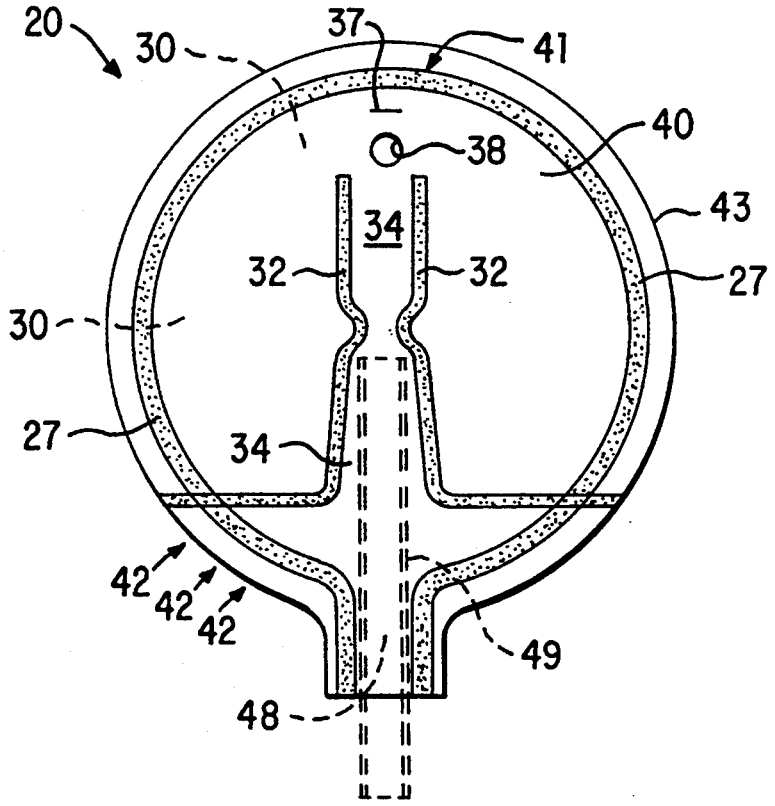
FIG. 21 is a front view of an inflatable flexible pouch according to yet another preferred embodiment of this invention.
Figure 28:
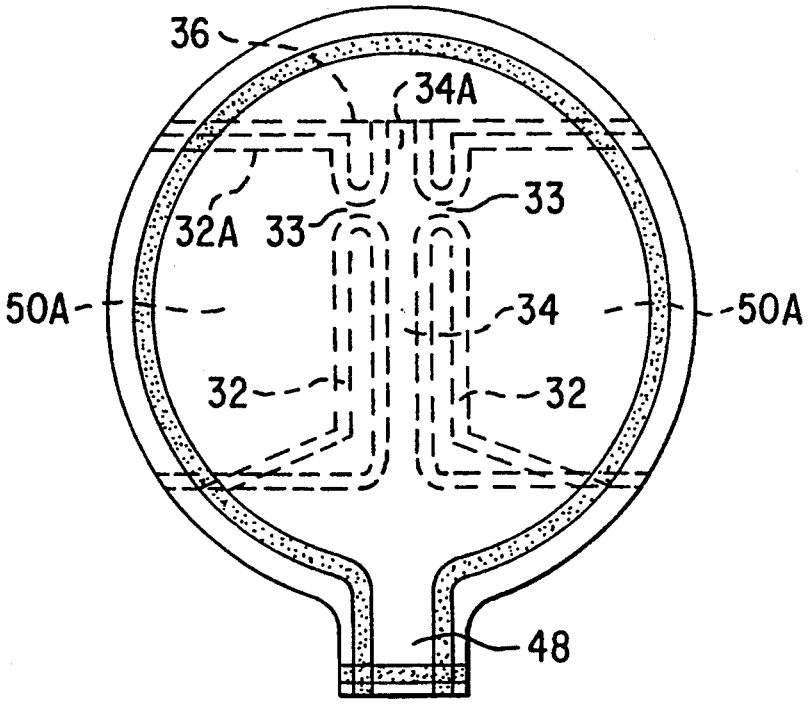

FIGS. 20 and 21 show other preferred arrangements of channel 34. Heat seals 32 can be designed to have a throat diameter "D" that is small enough to act as a stop for fill tube 49 and large enough to accommodate the insertion of a smaller diameter tube for deflation purposes. Such smaller diameter tube would preferably extend beyond free edge 36, as shown in FIG. 28, to deflate an inflated flexible pouch 20 by removing the fluid between outer webs 40 and within inflatable chamber 50A.

Figure 10:
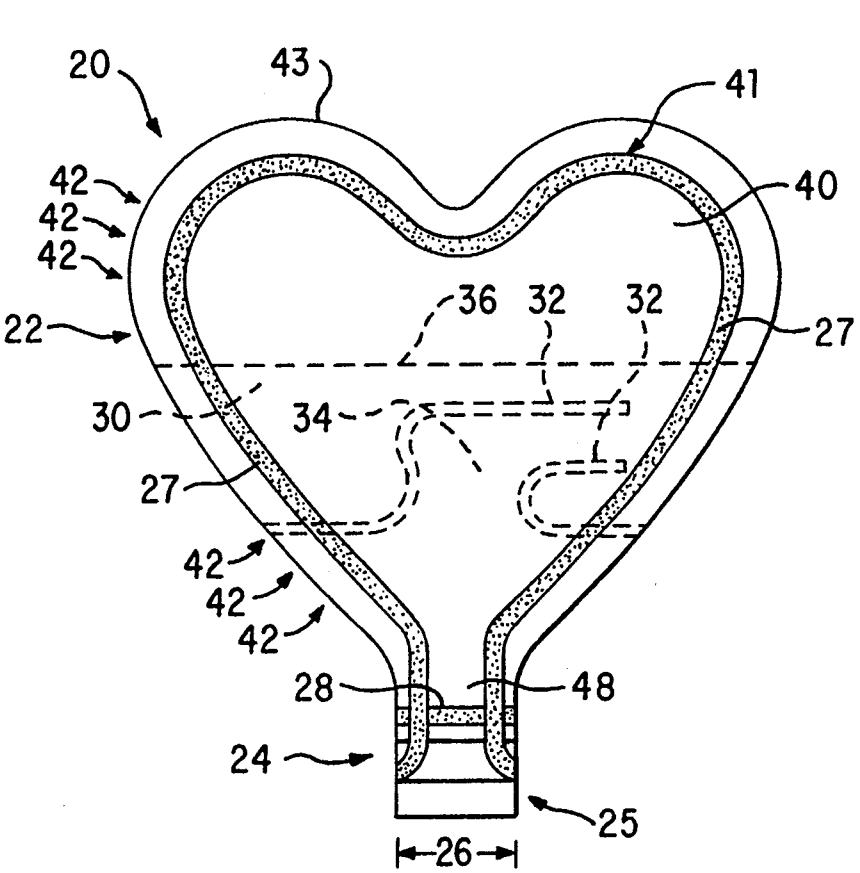
FIG. 10 is a front view of an inflatable flexible pouch having an overall heart shape, according to another preferred embodiment of this invention.
Figure 11:
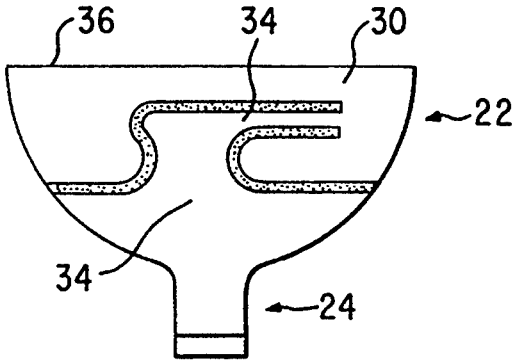
FIGS. 11–18 are front views of configurations of pairs of inner webs, according to various embodiments of this invention.
Figure 12:
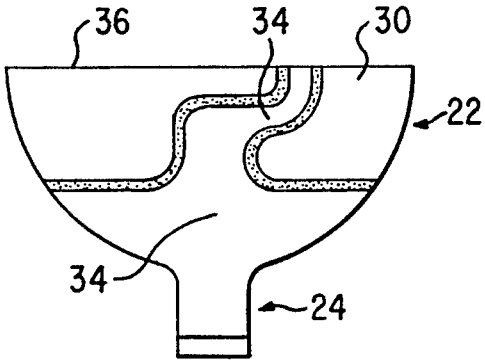
Figure 13:
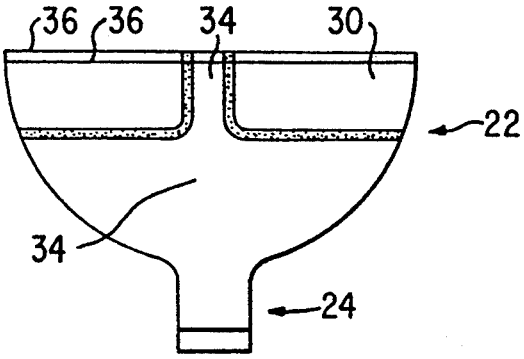
Figure 14:
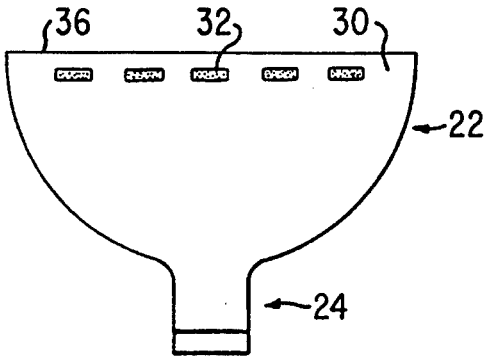
Figure 15:
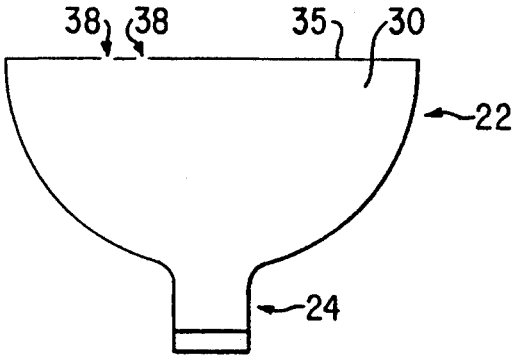

Although the attachment means between both inner webs 30 preferably comprise a heat seal, it is apparent that other bonding materials, such as adhesives and the like, can be used to form channel 34. As discussed in further detail later in this specification, in one preferred embodiment, the fluid that is used to inflate flexible pouch 20 flows through channel 34 and then either directly into inflatable chamber 50 or between both inner webs 30 and then into inflatable chamber 50. FIGS. 12 and 13 show channel 34 extending to free edge 36 of each inner web 30. FIGS. 1, 10 and 11 show channel 34 not extending as far as free edge 36. The sealing capabilities may differ depending upon channel 34 extending or not extending to free edge 36. The precise shape and length of channel 34 may also depend upon the particular fluid that is used to inflate flexible pouch 20 and upon whether it is desired to deflate an inflated flexible pouch 20 by inserting a straw or tube within inflatable chamber 50.

Figure 2:
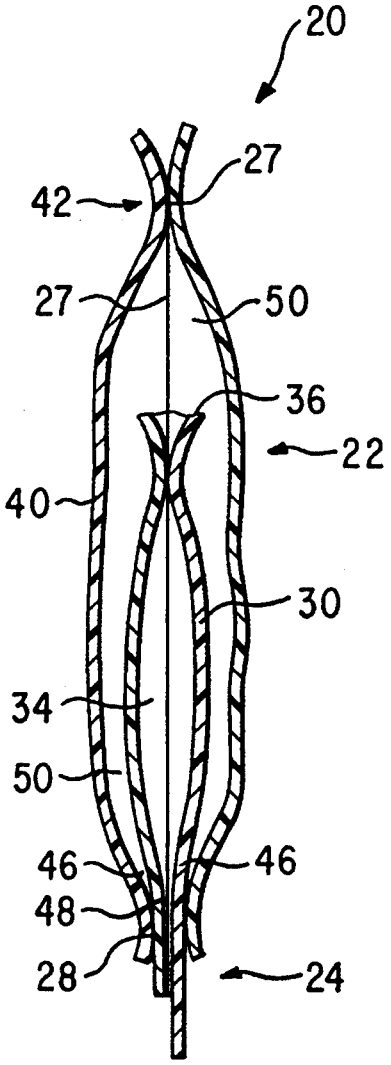
FIG. 2 is a sectional view taken along line 2—2, of the inflatable flexible pouch as shown in FIG. 1, in a deflated condition.
Figure 3:
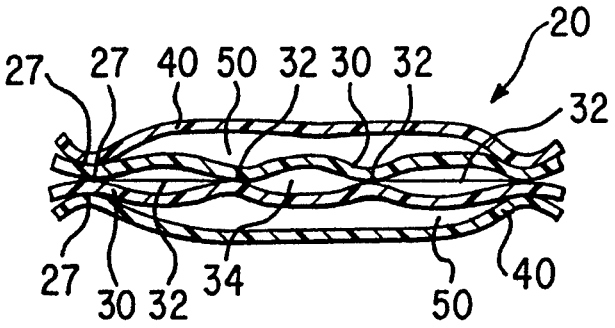
FIG. 3 is a sectional view taken along line 3—3, of the deflated flexible pouch, according to the embodiment as shown in FIG. 1.
Figure 4:
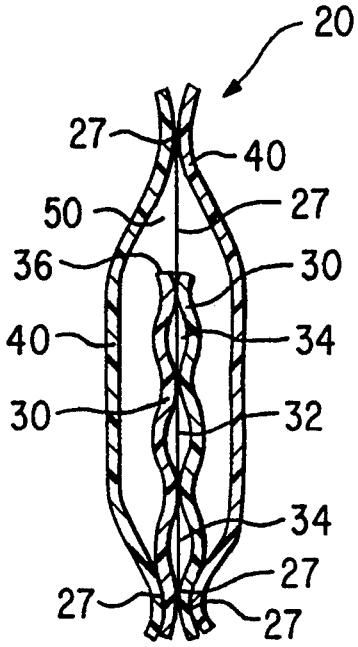
FIG. 4 is a sectional view taken along line 4—4, of the deflated flexible pouch, according to the embodiment as shown in FIG. 1.
Figure 5:
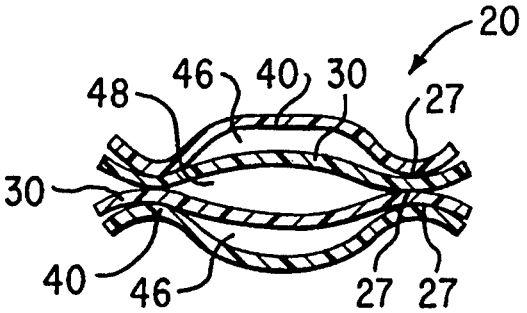
FIG. 5 is a sectional view taken along line 5—5, of the deflated flexible pouch, according to the embodiment as shown in FIG. 1.

Both inner webs 30 are positioned between both outer webs 40. Both outer webs 40 and both inner webs 30 are preferably positioned with respect to each other so that each neck portion 24 is aligned. Sealing means are used to sealably attach a first outer web 40 to a corresponding or adjacent first inner web 30 and to sealably attach a second outer web 40 to a corresponding or adjacent second inner web 30. According to one preferred embodiment of this invention, the first sealing means comprise heat seal 28, as shown in FIGS. 1, 2 and 6. However, it is apparent that other attachment methods apparent to those skilled in the art can be used, such as a suitable adhesive or other bonding material or process. Heat seal 28 can extend across the entire width 26 of neck portion 24. It is apparent that heat seal 28 can also extend only partially across neck portion 24; however, it is important for heat seal 28 to intersect the portions of heat seal 27 that extend along both edges or side sections of neck portion 24, as shown in FIGS. 1 and 10. Also shown in FIGS. 1 and 10, heat seal 28 is preferably positioned approximately perpendicular to the centerline axis of neck portion 24, but it is also apparent that heat seal 28 can be positioned at any suitable angle with respect to such centerline axis. It is also important for heat seal 28 to be a continuous heat seal so that in its inflated condition, inflatable flexible pouch 20 is leak-proof.

Other sealing means are used to sealably attach both outer webs 40, as well as the interpositioned inner webs 30, about a general periphery of body portion 22 and along both side sections of neck portion 24, and at least as far as heat seal 28. By extending heat seal 27 as far as heat seal 28 on each side of neck portion 24, an approximately semi-annular space 46 is formed between the first inner web 30 and the first outer web 40 and another approximately semi-annular space 46 is formed between the second inner web 30 and the second outer web 40, as most clearly shown in FIG. 9. It is apparent that by varying the length and shape of neck portion 24 and the position of heat seal 28, the length and shape of semi-annular space 46 can be varied.

The second sealing means also forms throat opening 48 within neck portion 24, between both inner webs 30. In a deflated condition of inflatable flexible pouch 20, throat opening 48 is in communication with channel 34 and an ambient atmosphere which is external to or surrounding inflatable flexible pouch 20. It is apparent that by varying the dimensions of neck portion 24 and the positioning of heat seals 27 and 28, throat opening 48 and semi-annular space 46 can have various dimensions and shapes.

FIGS. 2–5 show various sectional views taken along the respective lines as shown in FIG. 1, in a deflated condition of inflatable flexible pouch 20. Likewise, FIGS. 6–9 show sectional views of the same respective lines as shown in FIG. 1, with inflatable flexible pouch 20 in an inflated condition. For clarity purposes, FIGS. 2–9 may not show each and every visible line as seen in the respective sectional views when taken along the corresponding lines shown in FIG. 1.

Referring to FIGS. 2–5, in the deflated condition of inflated flexible pouch 20, channel 48 is in communication with inflatable chamber 50 which is defined between both outer webs 40. When inflatable flexible pouch 20 is inflated to a condition as shown in FIGS. 6–9, it is apparent that throat opening 48, channel 34 and the space between both inner webs 30 closes to form a seal which prevents pressurized fluid within inflatable chamber 50 from backflowing to the ambient atmosphere outside of or external to inflatable flexible pouch 20. Thus, in the inflated condition, the portion of both inner webs 30 at the channel 34 area are forced against each other to form a seal which prevents communication between channel 34 and inflatable chamber 50.

Figure 9:
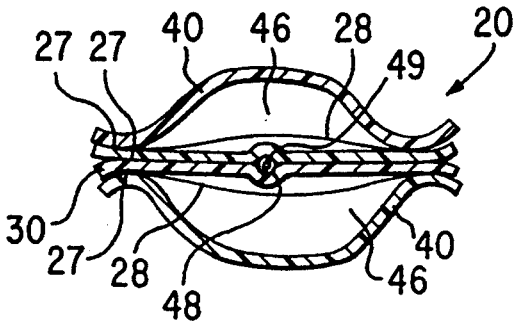
FIG. 9 is a sectional view taken along line 5—5, of the inflated flexible pouch, according to the embodiment as shown in FIG. 1.

As shown in FIG. 9, when in the inflated condition, semi-annular space 46 is filled with pressurized fluid and thus forces outer webs 40 outward and forces inner webs 30 against each other. FIG. 9 shows inner webs 30 closing throat opening 48 to the extent that inner webs 30 surround fill tube 49. It is apparent that fill tube 49 can be a conventional plastic straw or any other suitable fill tube known to those skilled in the art. As the fluid pressure within inflatable chamber 50 increases, the forces acting against inner webs 30 which tend to close inner webs 30 and throat 48 create an increased frictional fit between an external surface of fill tube 49 and inner webs 30, including the portion of inner webs 30 that form throat opening 48. Thus, once inflatable flexible pouch 20 is inflated to a certain pressure, inner webs 30 are forced together by backpressure within inflatable chamber 50 so that fill tube 49 can be detachably secured within throat opening 48 with a frictional fit between inner web 30 and fill tube 49 so that the inflated flexible pouch 20 is somewhat securedly attached to fill tube 49. It is thus apparent that fill tube 49 can act as a stem support for displaying inflated flexible pouch 20 as a plastic balloon, or the like.

As shown in FIGS. 1 and 10, neck portion 24 of one of the two inner webs 30 preferably is longer than the other inner web 30, at bottom area 25. Such arrangement accommodates easy insertion of fill tube 49 within throat opening 48. Also as shown in FIGS. 1 and 10 and according to one preferred embodiment of this invention, within neck portion 24, heat seal 27 flares out toward peripheral edge 43 of neck portion 24. Although such arrangement of heat seal 27 is preferred, it is not necessary for heat seal 27 to flare outward in such manner. It is only important for purposes of sealing inflatable flexible pouch 20 that heat seal 27 intersect heat seal 28, in order to complete the peripheral seal. However, the extension of heat seal 27 into the flared arrangement also accommodates initial entry of fill tube 49 within throat opening 48. Certain materials promote easy insertion of a straw or fill tube 49, even without a flared arrangement and with all four edges of inner webs 30 and outer webs 40 even with each other, thereby eliminating the loading lip at bottom area 25.

Figure 19:
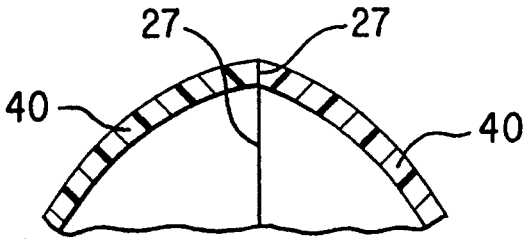
FIG. 19 is a cross-sectional view of a portion of the inflatable flexible pouch showing two outer webs forming an edge seal, according to yet another preferred embodiment of this invention.

As shown in FIGS. 1–9, heat seal 27 is positioned inward from peripheral edge 43 of either outer web 40. In another preferred embodiment according to this invention, heat seal 27 is positioned at peripheral edge 43 of both outer webs 40. Such peripheral heat seal, as shown in FIG. 19, is known to those skilled in the art as an edge seal.

Figure 16:
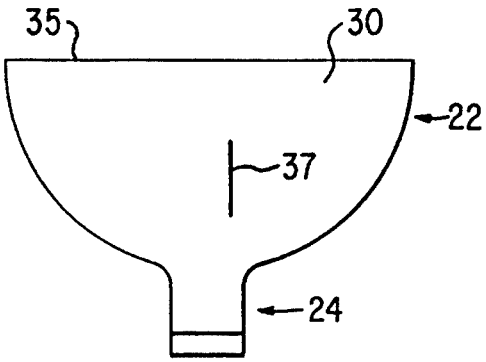
Figure 17:
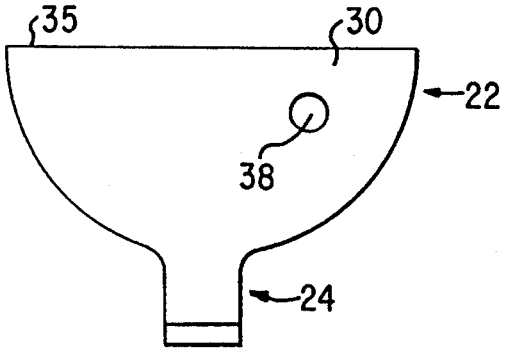
Figure 18:
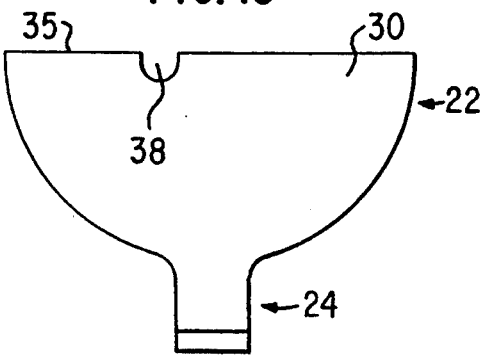

In another preferred embodiment according to this invention, the total area of body portion 22 of both inner webs 30 is less than a total sealed area of body portion 22 of both outer webs 40. Such arrangement ensures that the fluid which flows through throat opening 48, channel 34 and between both inner webs 30 eventually flows into inflatable chamber 50, between both outer webs 40. It is apparent that inner webs 30 can have the same area as the sealed area of the corresponding body portion 22 of outer webs 40; however, in such preferred embodiment, each inner web 30 must comprise either a slit or another suitable opening, similar to slit 37 as shown in FIG. 16 or opening 38 as shown in FIGS. 17 and 18. As shown in FIGS. 1, 10, 11, 12, and 14, it is necessary for inner webs 30 to form free edge 36 along at least a portion of the uppermost edge, with respect to the position as shown in FIG. 1, of inner webs 30. In a preferred embodiment according to this invention, inner webs 30 preferably extend from neck portion 24 upward to approximately one-half of the distance between neck portion 24 and uppermost portion 41 of heat seal 27, as shown in FIG. 1. However, depending upon the overall size of inflatable flexible pouch 20 and whether a straw or fill tube 49 is used, the extension of inner webs 30 can significantly vary. In the embodiments that have folded edge 35, it is apparent that one or both inner webs 30 can extend as far as uppermost portion 41.

FIG. 20 shows another preferred embodiment of inflatable flexible pouch 20 according to this invention. As shown, dimensions A–F can vary according to the preferred design and purpose of this invention. Dimension A is preferably of sufficient length to allow the pressure within inflatable chamber 50 to force inner webs 30 against fill tube 49 and thus firmly secure fill tube 49 in a fixed position with respect to inflatable flexible pouch 20. It is apparent that as the length of dimension A is increased, the frictional forces retaining fill tube 49 are increased. Also, as dimension A is increased with respect to dimension E, inflatable flexible pouch 20 becomes more rigid, with respect to fill tube 49.

Dimension B is preferably of sufficient length to allow inner webs 30 to collapse against each other so that a proper seal is formed, even with fill tube 49 fully positioned within channel 34. Dimension C of inner webs 30 is preferably sized to accommodate the desired design of inflatable flexible pouch 20. For example, if conserving web material is a concern, then dimension C is minimized. If dimension C is equal to dimension E, then slit 37 and/or opening 38, as shown in FIG. 21, must be positioned within at least one inner web 30 in order to fully inflate flexible pouch 20.

Dimension D is preferably small enough to prevent fill tube 49 from passing through the entire channel 34, as shown in FIG. 21, yet small enough to allow a smaller tube or straw to be inserted through channel 34 and preferably into inflatable chamber 50. Such design accommodates deflation procedures.

Figure 22:
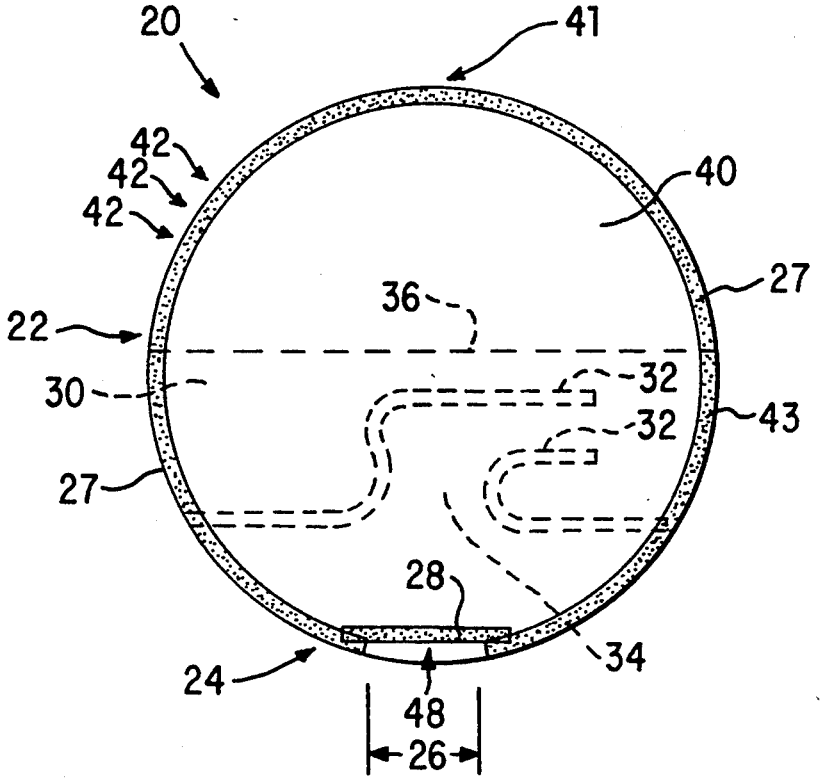
FIG. 22 is a front view of an inflatable flexible pouch according to still another preferred embodiment of this invention.

FIG. 22 shows still another preferred embodiment of flexible inflatable pouch 20, according to this invention. In such embodiment, throat opening 48 is formed between both inner webs 30 within body portion 22. Such embodiment does not necessarily require an extended neck portion 24, as shown and discussed with respect to previous preferred embodiments of this invention; as shown in FIG. 22, neck portion 24 is built-in to body portion 22. In this preferred embodiment, it remains important for heat seal 27 to intersect with heat seal 28, so that leakage does not occur.

Because at least a portion of inner webs 30 are attached to outer webs 40 at periphery 42 of body portion 22, the flat check valve according to this invention will not be backed out of the inflatable pouch by the relative backpressure within inflatable chamber 50 and/or by frictional forces when removing a straw or fill tube 49 from within throat opening 48.

Figure 23:
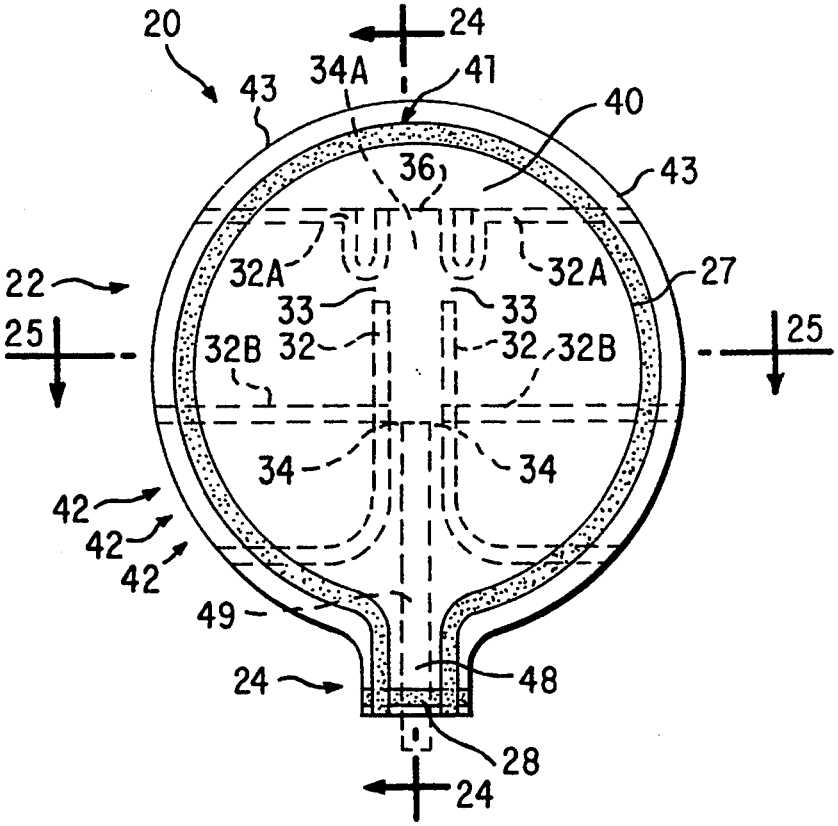
FIG. 23 is a front view of an inflatable flexible pouch according to another preferred embodiment of this invention.
Figure 24:
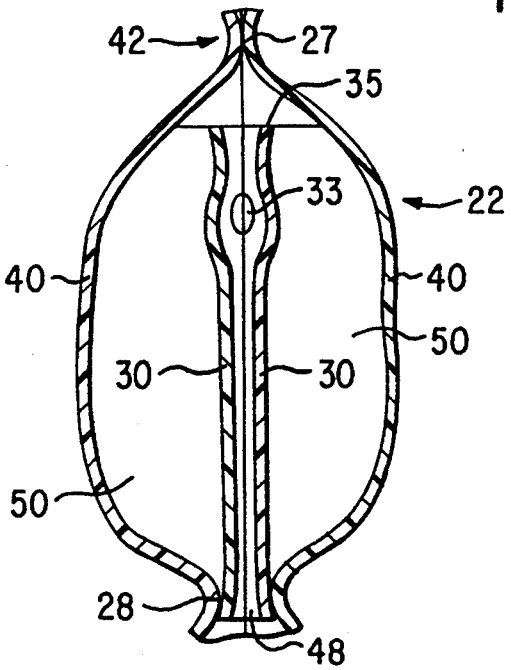
FIG. 24 is a sectional view taken along line 24—24, of the inflated flexible pouch as shown in FIG. 23.
Figure 25:
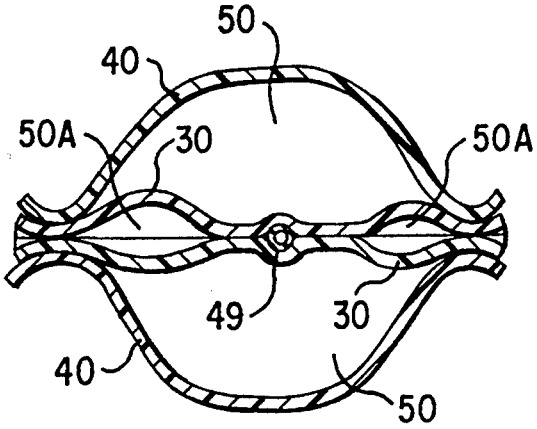
FIG. 25 is a sectional view, somewhat distorted, taken along line 25—25, of the inflated flexible pouch as shown in FIG. 23.

FIGS. 23–30 show various preferred embodiments of inflatable flexible pouch 20, according to this invention. In such preferred embodiments, as clearly shown in FIGS. 23 and 25, inflatable flexible pouch 20 comprises at least one, preferably two inner inflatable chambers 50A positioned between both outer webs 40. FIG. 25 shows the true inflated condition of such preferred embodiment of inflatable flexible pouch 20. Although FIG. 24 shows inflatable flexible pouch 20 in an inflated condition, the crosssectional drawing is somewhat distorted for clarification purposes, as discussed later in this specification. When inflated, inner webs 30 are forced against each other and thereby close or seal-off channel 34, as well as channel 34A, as clearly shown in FIG. 23.

The embodiments shown in FIGS. 26–34 include many of the same elements as the embodiment shown in FIG. 23, for example. However, for clarification purposes, FIGS. 26–34 do not contain many of the element reference numerals shown in FIG. 23, for example.

Referring to FIGS. 23–25, heat seals 32A are arranged on inner webs 30, so as to form channel 34A and bypass channels 33 between heat seals 32 and heat seals 32A. Heat seals 32B, as shown in FIG. 23, are arranged at the mid-region of body portion 22 for the purpose of forming inner inflatable chamber 50A only in the upper portion of and between both inner webs 30. It is apparent that with heat seals 32, 32A and 32B configured differently, the lower portion of body portion 22 could as well form inner inflatable chambers 50A, one on each side of channel 34, and accomplish the same result of this invention.

As shown in FIG. 24, inflatable flexible pouch 20 is in an inflated condition. However, FIG. 24 is somewhat distorted since inner webs 30 are shown spread apart for clarity purposes and to show bypass channel 33 and the inside surfaces of inner webs 30. A true cross section of FIG. 24 with inflatable flexible pouch 20 in an inflated condition would show inner webs 30 contacting or adjacent each other, as shown in FIG. 25, so as to close or seal-off channel 34.

Depending upon the particular design and configuration of channels 34 and 34A, as well as the positioning of heat seals 32, 32A and/or 32B, inner inflatable chamber 50A will preferably inflate either first or simultaneously with outer inflatable chamber 50. Pressurized fluid entering inflatable flexible pouch 20 through throat opening 48 will flow through a path of least resistance. Depending upon the particular design of the structure and channels 33, 34 and 34A, outer inflatable chamber 50 may inflate first; however, in such preferred embodiment, inflation of outer inflatable chamber 50 should not completely collapse inner webs 30 and thus inner inflatable chamber 50A. If the resistance of flow paths from throat opening 48 to inner inflatable chambers 50A and outer inflatable chamber 50 is equal, then both outer inflatable chamber 50 and inner inflatable chamber 50A will simultaneously inflate.

Thus, as shown in FIG. 23, if the flow resistance through channel 34A is greater than the flow resistance through bypass channel 33, inner inflatable chambers 50A will inflate first. Once inflated to the point where the backpressure creates greater resistance than the flow resistance through channel 34A, pressurized fluid entering channel 34 will then flow into outer inflatable chamber 50. In such case, when the pressure within outer inflatable chamber 50 is sufficient and fluid pressure within throat opening 48 is reduced, forces from the pressure will cause inner webs 30 to collapse against each other at channels 34 and 34A. Once fully collapsed and contacting each other, as shown in FIG. 25, channels 34 and 34A will close or be sealed-off and thus act as a check valve for preventing the pressurized fluid within inflatable flexible pouch 20 from flowing back through throat opening 48. The result of inflatable flexible pouch 20 according to this invention is a check valve effect that provides a tightly sealed and nearly leak-proof balloon-type enclosure.

When inflated and pressurized, inner inflatable chambers 50A create forces which act against inner webs 30 so that the inner structure of an inflated flexible pouch 20 provides significantly increased structural support or rigidity through inner webs 30, as compared to an inflatable pouch or balloon without such inner chambers and inner webs. Thus, when fill tube 49 is positioned within throat opening 48 and channel 34, as shown in FIG. 25, the inner structure which comprises inner webs 30 provides additional structural strength and thus neck portion 24 does not flex or bend with respect to body portion 22 as easily as does an inflatable flexible pouch 20 without inner webs 30.

Figure 26:
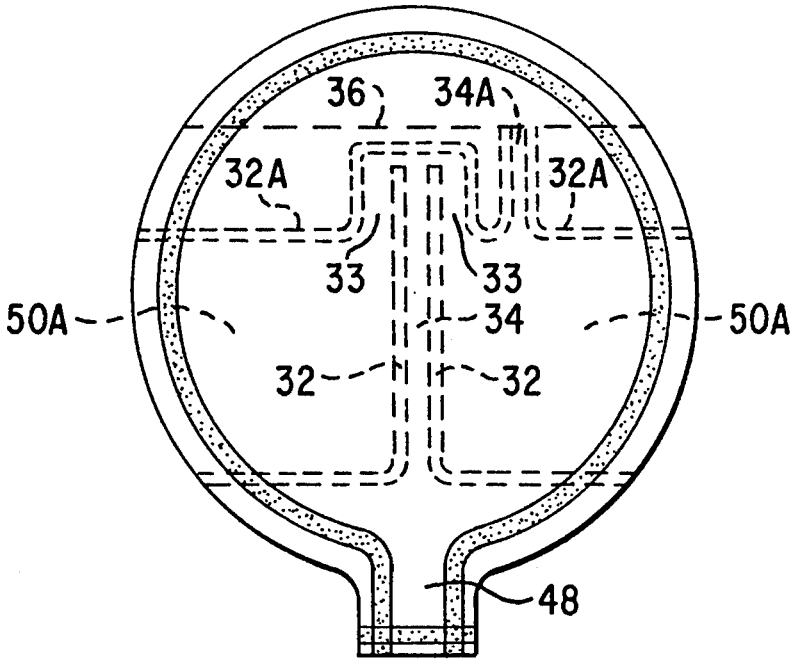
FIGS. 26–29 show various front views of an inflatable flexible pouches, each according to a different preferred embodiment of this invention.

As shown in FIG. 26, heat seals 32A form a differently shaped bypass channel 33. Such arrangement tends to inflate inner inflatable chamber 50A prior to inflating outer inflatable chamber 50. Also, as shown in FIG. 26, channel 34 closes and so does channel 34A, to form a double-seal which creates the check valve effect.

Figure 27:
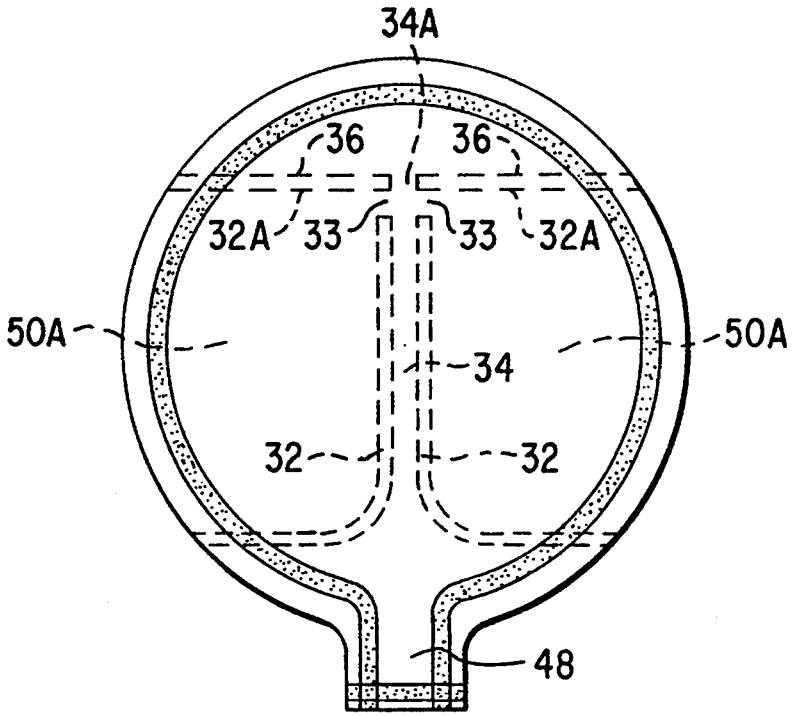
Figure 29:
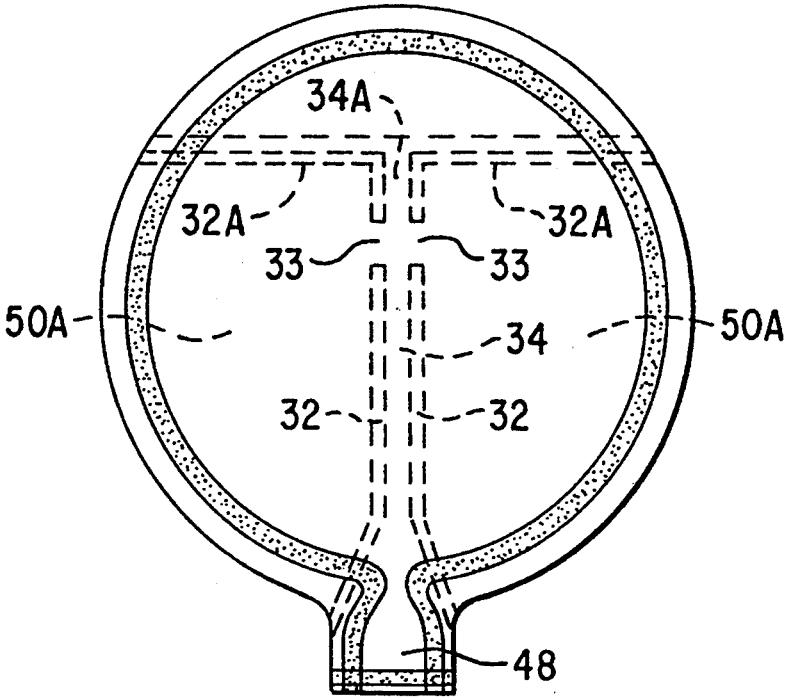

FIGS. 27–29 show other various configurations for heat seals 32 and 32A. It is apparent from such figures that heat seals 32, 32A, 32B can be arranged to provide various flow resistances and various shapes of channels 34 and 34A, bypass channel 33, and inner inflatable chambers 50A. It is apparent that in this preferred embodiment of the invention, only one inner inflatable chamber 50A is sufficient to provide additional rigidity or structural support within inflatable flexible pouch 20. However, two inner inflatable chambers 50A are preferred for obtaining additional and symmetrical inner structural support and sealing capabilities. As shown in FIG. 29, throat opening 48 converges and thus facilitates entry of fill tube 49 within channel 34.

Figure 30:
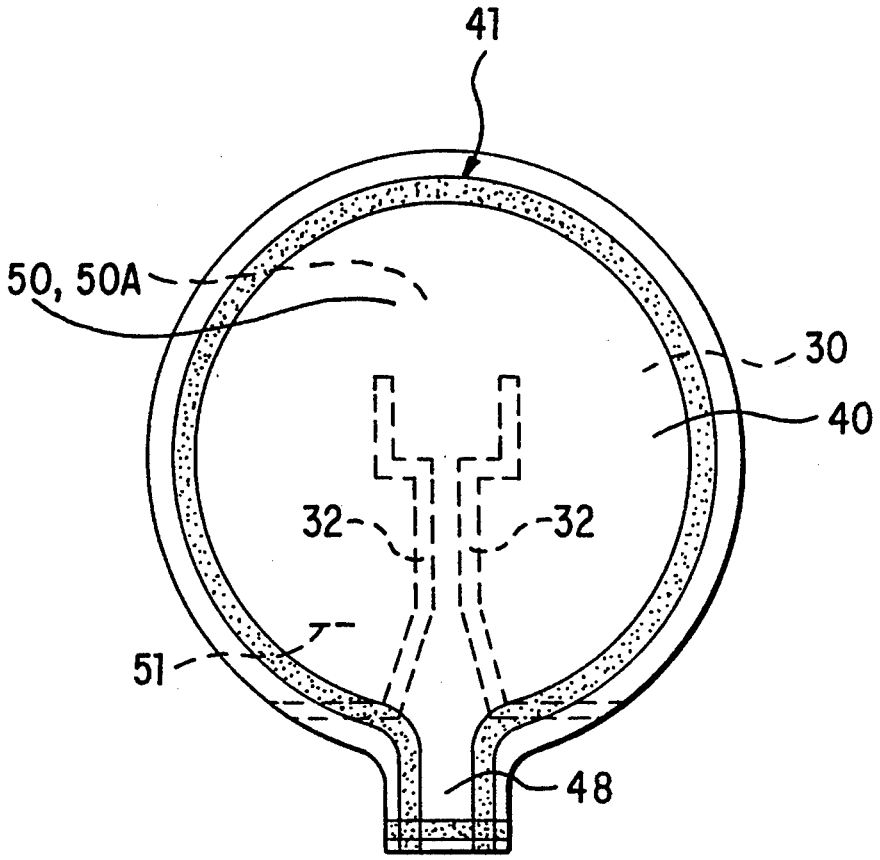
FIG. 30 shows a front view of an inflatable flexible pouch according to still another preferred embodiment of this invention.

According to the preferred embodiment shown in FIG. 30, inflatable flexible pouch 20 comprises two outer webs 40 and two inner webs 30. Each inner web 30 extends as far as uppermost portion 41 of outer web 40. When filling inflatable flexible pouch 20 of FIG. 30, the pressurized fluid will preferably first flow into inner inflatable chamber 50A since such flow path preferably has least resistance. Once inner inflatable chamber 50A is filled, the backpressure will cause the pressurized fluid to flow through one or more slits 51, which is shown in FIG. 30 as being positioned within inner web 30 and thus in communication with inner inflatable chamber 50A. However, it is apparent that slit or slits 51 can be positioned at other areas of inner web 30, as long as once inflated, the pressurized fluid does not bleed off to the atmosphere, for example, back through channel 34.

There is preferably at least one slit 51 within each inner web 30. However, slit 51 can be positioned within only one inner web 30. As shown in FIG. 30, because inner webs 30 extend the entire distance to uppermost portion 41, two independent and isolated outer inflatable chambers 50 are formed. Thus, if slit 51 is positioned within only one inner web 30, then the two independent and isolated outer inflatable chambers 50 must somehow communicate so that inflatable flexible pouch 20 can be completely inflated. Element reference numeral 50/50A is shown in FIG. 30 for the purpose of identifying that the four total webs, two inner webs 30 and two outer webs 40, form one inner inflatable chamber 50A and two independent and isolated outer inflatable chambers 50.

FIGS. 31–34 show other preferred embodiments of inflatable flexible pouch 20, which are particularly suitable for preferred embodiments of this invention wherein each inner inflatable chamber 50A remains in an at least partially inflated condition when flexible pouch 20 is inflated. Throughout this specification and in the claims, an at least partially inflated condition is intended to relate to inner inflatable chamber 50A and/or channel 34 having some fluid between the corresponding webs so as to form a space between the corresponding webs.

Figure 31:
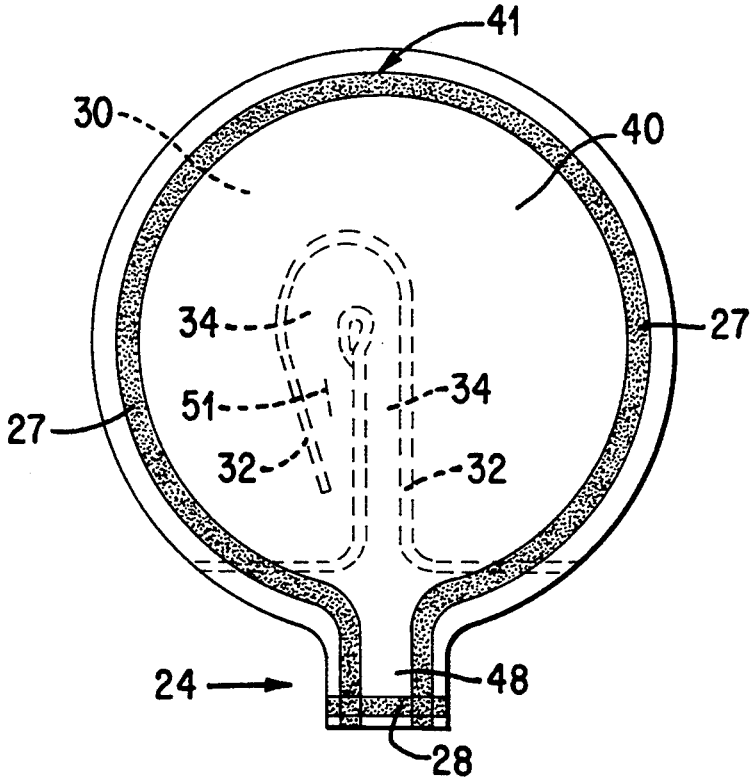
FIG. 31 shows a front view of an inflatable flexible pouch wherein the channel has a path which forms at least one bend, according to another preferred embodiment of this invention.

As in the previously discussed preferred embodiments, both outer webs 40 are sealably secured about periphery 42, as shown in FIGS. 31–34. Throughout this specification and in the claims, both outer webs 40 being sealably secured about general periphery 42 of body portion 22 of flexible pouch 20 relates to the area that outer webs 40 are heat sealed together, for example, as shown by heat seal 27 in FIGS. 31–34. It should be noted that such language is not limited to a heat seal, for example, that extends about the complete periphery of body portion 22. For example, as shown in FIG. 31, heat seal 27 does not extend across neck portion 24.

Figure 32:
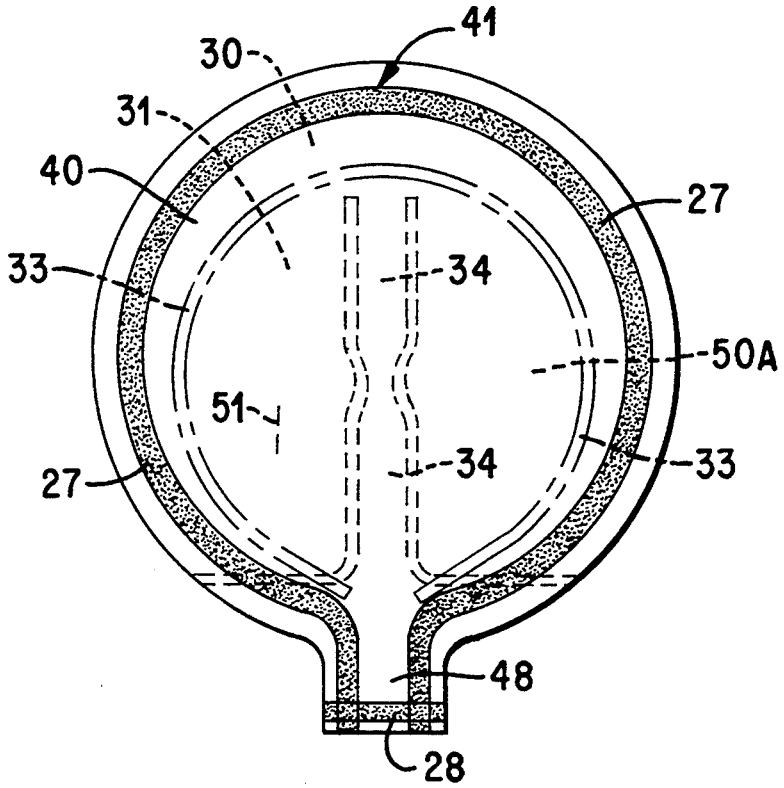
FIG. 32 shows a front view of an inflatable flexible pouch wherein the inner webs are secured to each other at a position away from the heat seal between the two outer webs, so as to form an inner inflatable chamber, according to another preferred embodiment of this invention.
Figure 34:
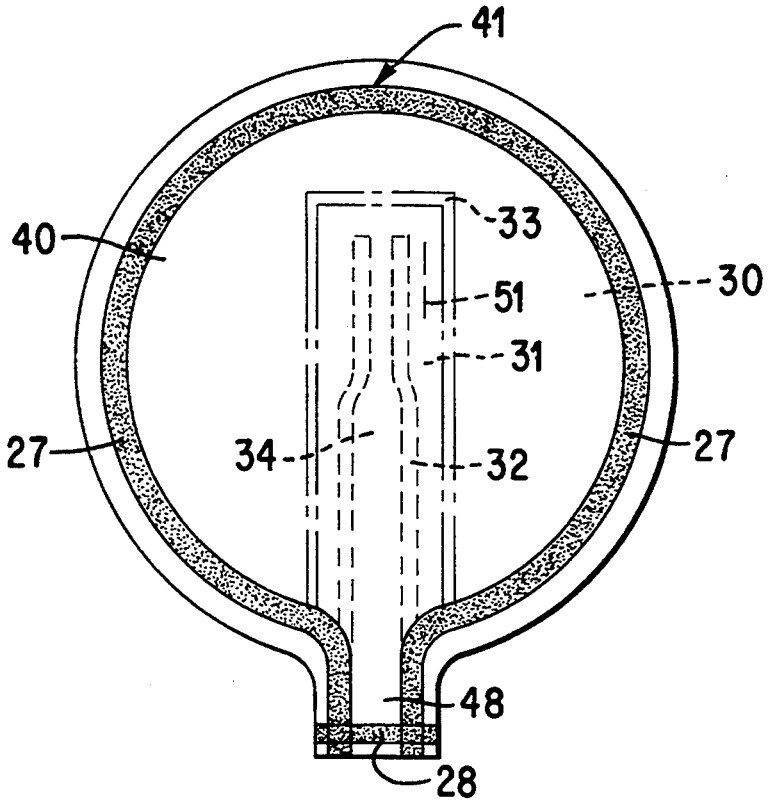
FIG. 34 shows a front view of an inflatable flexible pouch wherein one of the two inner webs is sealed with the two outer webs and the other inner web is only large enough to be heat sealed to the first inner web, so as to form a channel, according to another preferred embodiment of this invention.

According to one preferred embodiment of this invention, it is only necessary to have one inner web 30 positioned between both outer webs 40 and secured about at least a portion of general periphery 42, which preferably does not include neck portion 24. If only one inner web 30 is positioned between outer webs 40, about general periphery 42, then as best shown in FIGS. 32 and 34, channel web 31 can be secured to inner web 30 so as to form channel 34 and inner inflatable chamber 50A. As illustrated in FIG. 34, the surface area of channel web 31, which acts as the second inner web 30 as described in previous embodiments, can thus be substantially less than the surface area of inner web 30. Heat seal 33, which preferably forms the seal between inner web 30 and channel web 31, is shown by the phantom lines in FIGS. 32 and 34. It is apparent that channel web 31 can have any suitable overall shape.

By using channel web 31, such as shown in FIG. 34, it is apparent that the size of channel web 31 can be reduced so that a portion of channel 34 serves as inner inflatable chamber 50A. Thus, when flexible pouch 20 is in an inflated condition, it is apparent that a portion of channel 34 can be designed to act as inner inflatable chamber 50A which remains in an at least partially inflated condition, in order to provide added rigidity to the internal structure of inflatable flexible pouch 20.

As in the previously discussed embodiments of this invention, pressurized fluid is introduced within at least one inner inflatable chamber 50A and at least one outer inflatable chamber 50, such that in an inflated condition of flexible pouch 20, each inner inflatable chamber 50A is sealed, with respect to the atmosphere surrounding flexible pouch 20, in an at least partially inflated condition. The configurations shown in FIGS. 31–34 are particularly suitable for maintaining each inner inflatable chamber 50A in an at least partially inflated condition. Although inner inflatable chamber 50A is referred to as being at least partially inflated, which is intended to convey that inner inflatable chamber 50A does not necessarily have to be in a fully inflated condition, it should be noted that a fully inflated or nearly fully inflated inner inflatable chamber 50A provides additional rigidity to the inner structure of an inflated flexible pouch 20.

As shown in FIG. 31, channel 34 follows a path having one bend such that channel 34 nearly reverses direction. It is apparent that channel 34 can have any number of bends, depending upon a particular design. The number of bends, shape of channel 34, and the placement of slit 51, or another suitable opening forming communication between inner inflatable chamber 50A and outer inflatable chamber 50, will dictate whether the pressurized fluid first inflates inner inflatable chamber 50A, first inflates outer inflatable chamber 50, or inflates both simultaneously. The placement of slit 51, or any other suitable opening, can be an important aspect of this invention since proper placement can result in one inner web 30 and either another inner web 30 or channel web 31 collapsing against each other, when flexible pouch 20 is inflated, to tightly seal inner chamber 50A with respect to both outer chamber 50 and the ambient atmosphere surrounding an inflated flexible pouch 20.

FIGS. 32 and 34 show two other preferred embodiments comprising channel web 31 having less surface area than inner web 30. As shown in FIGS. 32 and 34, heat seal 33 is positioned away and does not intersect with heat seal 27. Thus, it is apparent that inner inflatable chamber 50A can have an overall shape as shown in FIG. 32, as shown in FIG. 34, or can have any other suitable overall shape. The embodiment shown in FIG. 34 is particularly suitable for relatively smaller inflatable flexible pouches 20.

Figure 33:
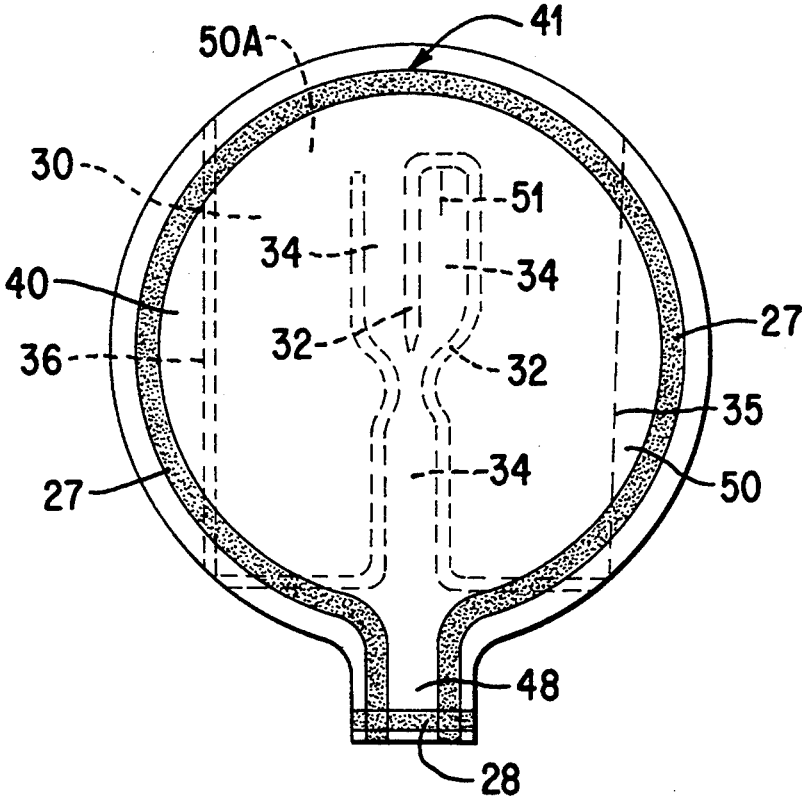
FIG. 33 shows a front view of an inflatable flexible pouch wherein the two inner webs are heat sealed at a free edge along a left side, and the two inner webs form a folded edge on the right side, according to another preferred embodiment of this invention.

FIG. 33 shows another preferred embodiment according to this invention, wherein channel 34 divides into one branch that communicates with outer inflatable chamber 50, through slit 51, and another branch that flows directly into inner inflatable chamber 50A. In FIG. 33, inner web 30 is shown with folded edge 35 on the right-hand side and heat sealed free edge 36 on the left-hand side. It is apparent that either side can be heat sealed or formed by a folded edge. It is also apparent that any folded edge 35 or free edge 36 can be positioned differently than as shown in FIG. 33.

The various components of inflatable flexible pouch 20 are preferably constructed of a polymeric material, such as a material comprising polyethylene or another heat sealable polyolefin. It is apparent that any one of the inner webs 30 or outer webs 40 can be at least partially coated with a metallic material, such as aluminum or an aluminum alloy. It is also apparent that any one or more of the webs of this invention can be of a metallic foil, a lamination or any other suitable material known to those skilled in the art.

The preferred embodiments of inflated flexible pouch 20 with at least one inner inflatable chamber 50A which remains in an inflated condition are most useful in relatively larger sizes of the overall pouch structure. As pouch structures or balloons become larger in diameter, the inner structural benefits of inflated chambers between inner webs 30 become more apparent.

Inflatable flexible pouch 20, according to this invention, is manufactured by first attaching both inner webs 30 to each other, such as with heat seal 32. It is apparent that both inner webs 30 can comprise two independent flexible films or one flexible film which is folded at folded edge 35 of inner web 30, as shown in FIGS. 15–18. By first forming heat seal 32 and thus channel 34, the two inner webs 30 can be heat sealed in a continuous and automated machine line. Once an appropriate channel 34 is formed, both inner webs 30 are positioned between both outer webs 40 and body portions 22 and neck portions 24 of all webs are aligned.

Heat seal 28 is preferably the second heat seal that is performed during the manufacturing process of inflatable flexible pouch 20. Once heat seal 28 is formed, heat seal 27 can then be formed about general periphery 42 of body portion 22 and within neck portion 24, as previously described. Heat seal 27 preferably intersects heat seal 32 but such intersection is not absolutely necessary.

It is apparent that the preferred embodiments of inflatable flexible pouch 20, as shown in FIGS. 23–34, can also be easily manufactured with a similar process. It is apparent from the preferred embodiments shown in FIGS. 23–34 that heat seals 32, 32A and 32B, bypass channel 33, and channels 34 and 34A can be arranged in various positions and shapes that accommodate maximum sealing capabilities. It is also apparent that by rearranging the shapes and dimensions of such elements, a more effective seal can be achieved.

Such manufacturing process of inflatable flexible pouches 20 according to this invention reduces labor and machinery costs, as compared to conventional plastic balloons that require manually assisted insertion, alignment and securement of an independent flat check valve within the balloon structure. Even if automated equipment is used for the insertion of conventional flat check valves, such valves would still be manufactured at a location remote from the balloon manufacturing. When inflating flexible pouch 20 according to this invention, the straw or fill tube 49 is held more securely and there is better rigidity of the balloon or flexible pouch 20, particularly with at least one inner inflatable chamber 50A, relative to the straw or fill tube 49. Furthermore, this invention results in a better sealing arrangement so that the pressurized fluid within inflatable chamber 50 does not leak or bleed-off through throat opening 48.

While in the foregoing specification this invention has been described in relation to certain preferred embodiments thereof, and many details have been set forth for purpose of illustration it will be apparent to those skilled in the art that the invention is susceptible to additional embodiments and that certain of the details described herein can be varied considerably without departing from the basic principles of the invention.

We claim:

1. An inflatable flexible pouch comprising:

a first outer web, a second outer web, an inner web, said first outer web and said second outer web sealably secured about a general periphery of a body portion of said first outer web and said second outer web forming at least one outer inflatable chamber between said first outer web and said second outer web, said inner web positioned between said first outer web and said second outer web and secured about at least a portion of said general periphery;

first means for said inner web forming at least one inner inflatable chamber wherein each said inner inflatable chamber is positioned between said first outer web and said second outer web; and second means for introducing pressurized fluid within said at least one inner inflatable chamber and said at least one outer inflatable chamber such that in an inflated condition of the inflatable flexible pouch said at least one inner inflatable chamber is at least partially inflated, and said second means comprising a channel web, said inner web and said channel web forming a channel which is in communication with said at least one inner inflatable chamber and said it least one outer inflatable chamber.

2. An inflatable flexible pouch according to claim 1 wherein said channel web is secured to said inner web about said at least said portion of said general periphery.

3. An inflatable flexible pouch according to claim 1 wherein said channel web is secured to said inner web at least partially about said general periphery.

4. An inflatable flexible pouch according to claim 1 wherein said channel follows a path having at least one bend.

5. An inflatable flexible pouch according to claim 1 wherein in an inflated condition of the inflatable flexible pouch said inner web and said channel web are forced against each other along at least a portion of said channel forming a seal which prevents communication between said at least one outer inflatable chamber and an atmosphere surrounding said inflatable flexible pouch.

6. An inflatable flexible pouch according to claim 1 wherein said first means comprise at least one heat seal joining said inner web and said channel web.

7. An inflatable flexible pouch according to claim 6 wherein each said heat seal is continuous.

8. An inflatable flexible pouch according to claim 1 wherein said inner web and said channel web are sealed together along a free side edge portion of said inner web and said channel web and said free side edge portion is positioned within said at least one outer chamber.

9. An inflatable flexible pouch according to claim 1 wherein said inner web is folded-over along a free edge which is positioned within said at least one outer chamber.

10. An inflatable flexible pouch according to claim 1 further comprising inflation means for simultaneously introducing pressurized fluid within said at least one inner inflatable chamber and said at least one outer inflatable chamber.

11. An inflatable flexible pouch according to claim 1 further comprising inflation means for introducing pressurized fluid within said at least one inner inflatable chamber until backpressure within said at least one inner inflatable chamber is increased enough for said pressurized fluid to flow into said at least one outer inflatable chamber.

12. An inflatable flexible pouch according to claim 1 wherein each of said first outer web, said second outer web and said inner web is of a polymeric material.

13. An inflatable flexible pouch according to claim 1 wherein at least one of said first outer web and said second outer web is at least partially coated with a metallic material.

14. An inflatable flexible pouch according to claim 1 wherein at least one of said first outer web and said second outer web is of a metallic foil.

15. An inflatable flexible pouch comprising:

a first outer web, a second outer web, an inner web, said first outer web and said second outer web sealably secured about a general periphery of a body portion of said first outer web and said second outer web forming at least one outer inflatable chamber between said first outer web and said second outer web, said inner web positioned between said first outer web and said second outer web and secured about at least a portion of said general periphery;

first means for said inner web forming at least one inner inflatable chamber wherein each said inner inflatable chamber is positioned between said first outer web and said second outer web; and second means for introducing pressurized fluid within said at least one inner inflatable chamber and said at least one outer inflatable chamber such that in an inflated condition of the inflatable flexible pouch said at least one inner inflatable chamber is at least partially inflated, and second means comprising said first inner web and a channel web secured together forming a first channel branch in communication with an ambient atmosphere surrounding the inflatable flexible pouch and in communication with said at least one outer inflatable chamber, and said second means forming a second channel branch in communication with said first channel branch and in communication with said inner inflatable chamber.

16. An inflatable flexible pouch comprising:

a first outer web, a second outer web, an inner web, said first outer web and said second outer web sealably secured about a general periphery of a body portion of said first outer web and said second outer web forming at least one outer inflatable chamber between said first outer web and said second outer web, said inner web positioned between said first outer web and said second outer web and secured about at least a portion of said general periphery;

first means for said inner web forming at least one inner inflatable chamber wherein each said inner inflatable chamber is positioned between said first outer web and said second outer web; and second means for introducing pressurized fluid within said at least one inner inflatable chamber and said at least one outer inflatable chamber such that in an inflated condition of the inflatable flexible pouch said at least one inner inflatable chamber is at least partially inflated, and each of said first outer web, said second outer web and said inner web further comprising a neck portion extending from said body portion.

* * * * *